United States Patent [19]

Tittizer et al.

[11] Patent Number: 4,821,689

[45] Date of Patent: Apr. 18, 1989

[54] VALVE DRIVE WITH A HYDRAULIC TRANSMISSION AND A CHARACTERISTIC VARIABLE BY MEANS OF A LINK CONTROL

[75] Inventors: Gabriel Tittizer, Roesrath; Ewald Junghans, Bergisch-Gladbach, both of Fed. Rep. of Germany

[73] Assignee: Interatom GmbH, Bergisch-Gladbach, Fed. Rep. of Germany

[21] Appl. No.: 154,794

[22] Filed: Feb. 10, 1988

[30] Foreign Application Priority Data

Feb. 10, 1987 [DE] Fed. Rep. of Germany ..... 3704071

[51] Int. Cl.[4] ..... F01L 9/02

[52] U.S. Cl. ..... 123/90.12; 123/90.15

[58] Field of Search ..... 123/90.12, 90.13, 90.15

[56] References Cited

U.S. PATENT DOCUMENTS

| | | | |
|---|---|---|---|
| 2,692,588 | 10/1954 | Cathers . | |
| 2,827,884 | 3/1958 | Stivender | 123/90.12 |
| 3,727,595 | 4/1973 | Links | 123/90.15 |
| 4,476,823 | 10/1984 | Williams | 123/90.12 |

FOREIGN PATENT DOCUMENTS

| | | | |
|---|---|---|---|
| 0191376 | 8/1986 | European Pat. Off. . | |
| 1962323 | 6/1971 | Fed. Rep. of Germany . | |
| 2428144 | 1/1980 | France . | |
| 2480853 | 10/1981 | France . | |
| 2552492 | 3/1985 | France | 123/90.12 |

*Primary Examiner*—Charles J. Myhre
*Assistant Examiner*—Weilun Lo
*Attorney, Agent, or Firm*—Herbert L. Lerner; Laurence A. Greenberg

[57] ABSTRACT

A valve drive assembly for an internal combustion engine includes a given number of pistons, the given number of inlet or outlet valves each being connected to a piston and independently movable by hydraulic fluid acting upon the pistons, at least one rotatable link disposed in a housing for aiding in shutting off and releasing a supply of hydraulic fluid to the pistons at regular intervals, and an auxiliary shaft supported in the rotatable link and driven by a crankshaft. First and second supply lines for hydraulic fluid lead from a hydraulic pump to first and second annular grooves formed in the housing. The rotatable link has the given number of radial third and fourth conduits formed therein communicating with the first and second annular grooves. The auxiliary shaft has fifth and sixth annular grooves formed therein communicating with the third and fourth conduits. Fifth and sixth conduits communicate with the fifth and sixth annular grooves. Seventh and eighth conduits communicate with the fifth and sixth conduits. Third and fourth annular grooves lead from the seventh and eighth conduits to first and second conduits which lead to the pistons. Ribs divide the fifth and sixth annular grooves into the given number of sectors.

12 Claims, 2 Drawing Sheets

VALVE DRIVE WITH A HYDRAULIC TRANSMISSION AND A CHARACTERISTIC VARIABLE BY MEANS OF A LINK CONTROL

The invention relates to a valve drive for an internal combustion engine including an auxiliary shaft driven by the crankshaft, a hydraulic pump, and valves each being independently movable by the action of the hydraulic fluid upon a piston, the auxiliary shaft being provided with rotatable links, with the aid of which the supply of hydraulic fluid to the valves is shut off and then released once again at regular intervals.

Published European Application No. 0 191 376 discloses a valve drive with hydraulic translation, by means of which a relatively short control movement can be converted into a relatively long valve stroke, in a manner not attainable with conventional camshafts because of the limitation of the steepness of the sides of the cams. This has made it possible to vary the valve characteristics from the previously conventional, more or less sinusoidal form to an approximately rectangular form, which appears favorable for improving the economy and the toxic emissions of internal combustion engines. Nevertheless, this valve drive only permits a fixed valve characteristic which is set for the most frequently occurring operational state of the engine and is not necessarily optimal in other operating states. To make it optimal, it would be necessary to vary the length and duration of the valve stroke of the individual valve and possibly even the length of the period of time in which both the inlet and the outlet valve are simultaneously opened, or in other words the extent of overlap of the two valve characteristics.

To this end, French Pat. No. 2 480 853 has proposed a hydraulic valve control in which the characteristics of hydraulically actuated valves acted upon from a central pressure source are varied by providing that a passage for the hydraulic fluid that is variable as a function of various operating parameters of the engine is created by means of two links that are rotatable counter to one another. However, due to the variable viscosity of the hydraulic fluid at various engine operating temperatures, accurate valve control is not attainable with a device of this type.

It is accordingly an object of the invention to provide a valve drive with a hydraulic transmission and a characteristic variable by means of a link control, which overcomes the hereinafore-mentioned disadvantages of the heretofore-known devices of this general type and which permits the valve characteristic to be varied in accordance with the various operating requirements.

With the foregoing and other objects in view there is provided, in accordance with the invention, a valve drive assembly for an internal combustion engine having a crankshaft, comprising:

(a) a given number of pistons, the given number of inlet or outlet valves each being connected to a respective one of the pistons and independently movable by hydraulic fluid acting upon the pistons, a housing, at least one rotatable link disposed in the housing for aiding in shutting off and releasing a supply of hydraulic fluid to the pistons at regular intervals, an auxiliary shaft supported in the at least one rotatable link and driven by the crankshaft;

(b) first and second conduits communicating with the pistons; a hydraulic pump: first and second supply lines for hydraulic fluid leading from the hydraulic pump to first and second annular grooves formed in the housing; the at least one rotatable link having the given number of radial third and fourth conduits formed therein communicating with the first and second annular grooves; the auxiliary shaft having fifth and sixth annular grooves formed therein communicating with the third and fourth conduits; fifth and sixth conduits communicating with the fifth and sixth annular grooves; seventh and eighth conduits communicating with the fifth and sixth conduits; third and fourth annular grooves leading from the seventh and eighth conduits to the first and second conduits: and (c) ribs dividing the fifth and sixth annular grooves into the given number of sectors.

The cross section that is valuable for the passage of the hydraulic fluid can be regulated by the rotation of the links, and thus the valve stroke can be regulated as well. If the auxiliary shaft, which is driven from the crankshaft (typically at half the rotational speed thereof) rotates, then the supply of hydraulic fluid to the particular valve is varied at regular intervals. The duration of the interruption and thus the duration of the valve opening time are determined by the respective circumferential length of the fifth and sixth conduits. It is not only suitable to act upon the valves with hydraulic fluid in one direction of motion thereof (as in the French reference referred to above) while performing the restoring motion by means of a spring, but also to perform the adjusting motion of the valve by means of the alternating action of a double piston. Correspondingly, two hydraulic lines are to be provided for each valve.

In accordance with another feature of the invention, the at least one rotatable link is in the form of two links, and there are provided means for rotating the links in mutually opposite directions relative to the housing. These features enable the valve opening and closing times of the inlet and outlet valves to be controlled contrary to one another, so that an alternatingly large overlap of the two valve characteristics can be attained.

In accordance with a further feature of the invention, the links have axes and crown gears disposed thereon, and the means for rotating the links are in the form of a positioning gear wheel between the links being rotatable transverse to the axes and meshing with the crown gears. This provides a construction for the mutual rotatability of the links that is particularly favorable.

In accordance with an added feature of the invention, the auxiliary shaft is axially displaceable, and the fifth and sixth conduits have mouths on surfaces thereof in various cross-sectional planes occupying variously dimensioned portions of the periphery of the auxiliary shaft. This structure makes it possible to vary the height of the valve stroke, since if there is a variation in the time during which hydraulic fluid can travel to the particular valve, then the extent of the motion of the piston displacing the valve is varied as well.

In accordance with an additional feature of the invention, the auxiliary shaft is formed of two telescoping parts, one of the parts having the fifth and sixth annular grooves formed therein or fifth and sixth conduits disposed therein, and the other of the parts having drive elements. This feature permits the aforementioned axial displacement of the auxiliary shaft, without also having to simultaneously displace the elements required for driving it.

Particularly during operation in motor vehicles, the operating parameters of internal combustion engines vary continuously, so that it seems desirable for the valve characteristic to be automatically adapted to the changes. In order to accomplish this, in accordance with another feature of the invention, there are provided positioning devices effecting axial displacement of the auxiliary shaft and/or rotation of the at least one link toward one another, and means for controlling the positioning devices in such a manner that the valves have a stroke and an opening time following set-point values determined as a function of measured operating parameters of the engine.

Since the engine is continuously operated with an optimal valve setting, not only are good fuel consumption values attained, but the production of toxic combustion residues is also minimized.

In accordance with yet another feature of the invention, there is provided a process control computer ascertaining a set-point value from current operating parameters of the engine, a travel pickup for each of the valves issuing a measurement signal, and a comparator receiving the measurement signal as an actual value and comparing the actual value with the set-point value ascertained by the process control computer, the comparator sending control signals to the positioning devices upon deviations of the actual value from the set-point value. This construction permits an automatic adaptation of this kind to be most favorably be effected.

In accordance with yet a further feature of the invention, the current operating parameters are selected from the group consisting of rpm, torque and temperature. A valve drive in accordance with the invention is most advantageously operated with these parameters.

Other features which are considered as characteristic for the invention are set forth in the appended claims.

Although the invention is illustrated and described herein as embodied in a valve drive with a hydraulic transmission and a characteristic variable by means of a link control, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figures 1, 2, 3:
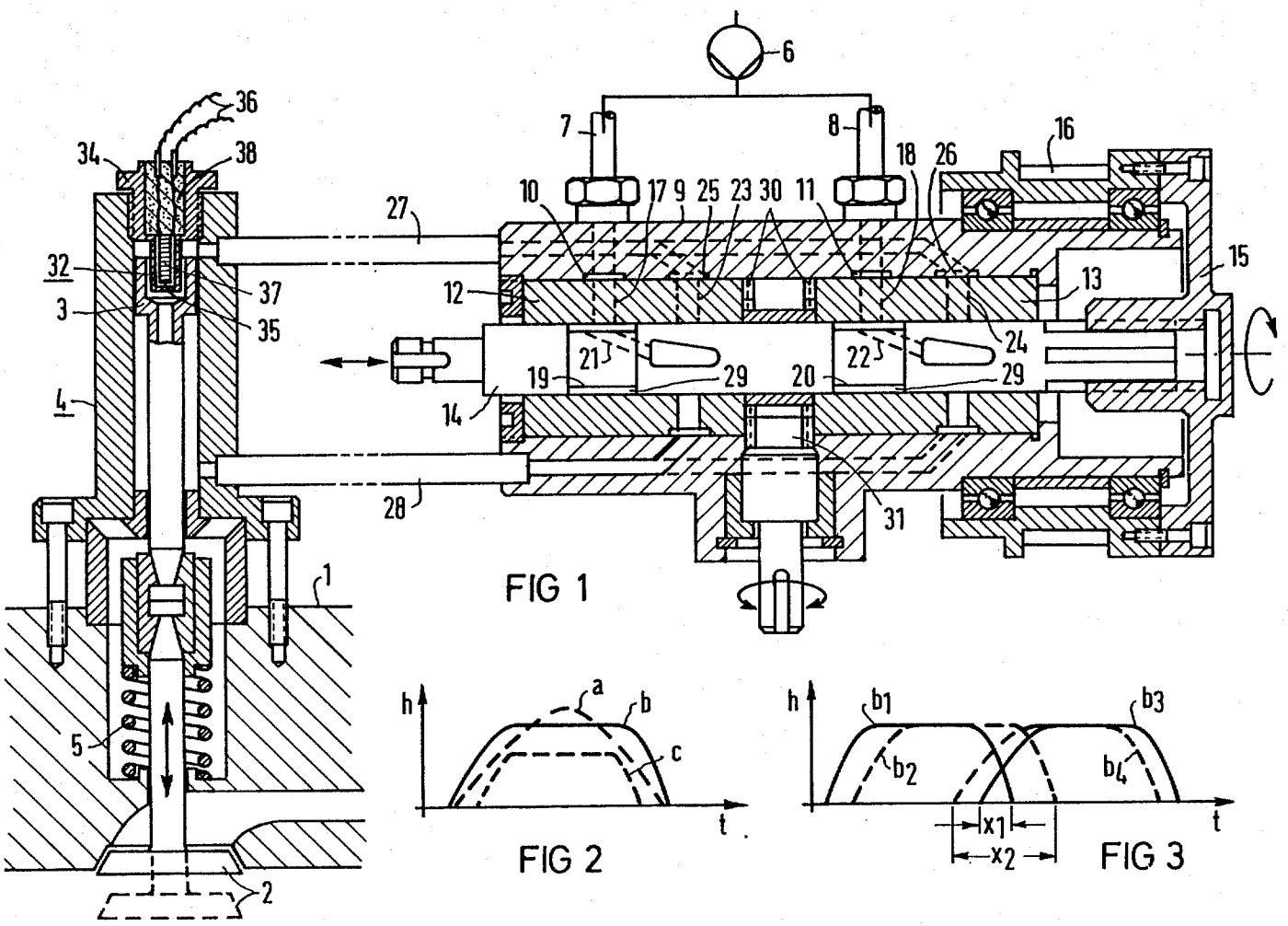
FIG. 1 is a fragmentary, diagrammatic, longitudinal, axial-sectional view of a valve drive.
FIGS. 2 and 3 are graphs of typically attainable valve characteristics.

Referring now to the figures of the drawings in detail and first, particularly, to FIG. 1 thereof, there is seen one of a multiplicity of valves 2 which are disposed in an engine block 1. The valve 2 is actuated by the displacement of a piston 3 manufactured from a ferritic material. The piston slides in a control cylinder 4 secured to the engine block 1 and is alternatingly acted upon at one or the other end thereof with hydraulic fluid. The position of the piston 3 at a particular time is detected by a contactless travel pickup 32, which is formed of a housing 34 that is inserted into the top of the control cylinder 4 and is manufactured from a nonmagnetic and possibly austenitic material. An electromagnet formed of a magnetic core 35 and a coil 37 is accommodated in the housing 34 and separated therefrom by means of insulation 38, the coil 37 being supplied through supply lines 36. The magnetic field which closing through the wall of the control cylinder 4 in the upper position of the piston 3, collapses once the piston 3 moves downward. A spring 5 serves not to restore the valves themselves as in conventional valves, but instead serves only to compensate for play. First and second supply lines 7, 8 begin at an oil pump 6 which is schematically illustrated in the drawing and has a variable flow rate, these lines being intended for the separate actuation of the inlet or outlet valves. The lines discharge in respective first and second encompassing annular grooves 10, 11 in the interior of a housing 9. First and second links, sliding blocks or cranks 12, 13 are rotatably disposed in the interior of the housing 9, and an auxiliary shaft is in turn disposed in the links. The auxiliary shaft is formed of two telescoping parts 14, 15, including a stationary part 15 which may be provided with a toothed drive wheel 16, by means of which the auxiliary shaft 14, 15 is driven in a known manner by a non-illustrated crankshaft of an internal combustion engine by means of a non-illustrated toothed belt, at half the crankshaft rpm. The first and second links 12, 13 are provided with respective radially extending third and fourth conduits 17, 18 through which the hydraulic fluid that has reached the respective first and second annular grooves 10, 11 can flow. The hydraulic fluid flows from the third and fourth conduits into respective fifth and sixth annular grooves 19, 20 in the auxiliary shaft 14. Fifth and sixth conduits 21, 22 extend axially from the fifth and sixth annular grooves as far as the cross-sectional plane of seventh and eighth conduits 23, 24, which likewise extend radially through the links 12, 13 and discharge into respective third and fourth annular grooves 25, 26. First and second conduits 27, 28, which are equal in number to the number of pistons, lead from each of the third and fourth annular grooves to a corresponding control cylinder 4 for each valve.

The duration of the action of hydraulic fluid on the associated piston 3 and thus the displacement travel thereof as well, are determined by means of the circumferential size of the mouth of the fifth and sixth conduits 21, 22 on the surface of the auxiliary shaft 14. At the same time, the displacement travel equals the valve stroke which is attained. The fifth and sixth annular grooves 19, 20 are divided by ribs 29 which extend from the shaft 14 radially out toward the links 12, 13 and extending in the axial direction along the auxiliary shaft 14, into as many chambers as there are valves to be actuated. The fifth and sixth conduits 21, 22 being branched at their upstream ends thereby leading to respective chambers. The ends of the links 12, 13 facing one another are provided with crown gears 30. A positioning gear wheel that is rotatable about a transverse shaft meshes with the teeth of the crown gears, so that upon rotation thereof, the links 12, 13 rotate counter to one another. This makes it possible to vary the chronological association of the valve control times of the inlet and outlet valves.

This property is illustrated by FIGS. 2 and 3. In FIG. 2, in which h represents the valve stroke and t represents time, the curve a shows the previously conventional, approximately sinusoidal control characteristic of the valves that can be attained with the typical cam control. On the other hand, curve b is a more rectangular control curve that can be attained with the apparatus according to the invention of the instant application.

The large valve stroke shown in this way results whenever the displaceable part 14 of the auxiliary shaft is displaced in such a way that portions of the mouths of the fifth and sixth conduits 21, 22 extending over a relatively large part of the circumference come to rest opposite the seventh and eighth conduits 23, 24, respectively, as shown toward the right in FIG. 1. The seventh and eight conduits 23, 24 are equal in number to the number of pistons. Due to the longer time of overlap of these openings per revolution of the auxiliary shaft 14, 15, a larger quantity of hydraulic fluid passes through, bringing about a longer displacement travel of the piston 3. Conversely, if the displaceable part 14 of the auxiliary shaft is displaced in the other direction, then because of the then-smaller effective cross section of the openings of the fifth and sixth conduits 21, 22, the overlapping time becomes shorter. Less hydraulic fluid then passes through and the piston 3 is only displaced over a shorter path, so that the valve characteristic c of FIG. 2 results. In the diagram of FIG. 3, in which once again h represents the valve stroke and t represents time, the valve curves for both an inlet and an outlet valve $b_1$ and $b_3$ are shown with valve characteristics that overlap over a distance $x_1$. In other words, for the corresponding period of time both valves are opened at the same time. In other operating conditions, it may be more favorable to lengthen the duration of simultaneous opening, which means that the range of the overlap is extended over the distance $x_2$. To this end, the curves $b_1$ and $b_3$ are displaced symmetrically relative to one another toward the curves $b_2$ and $b_4$, respectively, which is attained by means of a rotation of a positioning gear wheel 31 and thus of the links 12, 13.

Figure 4:
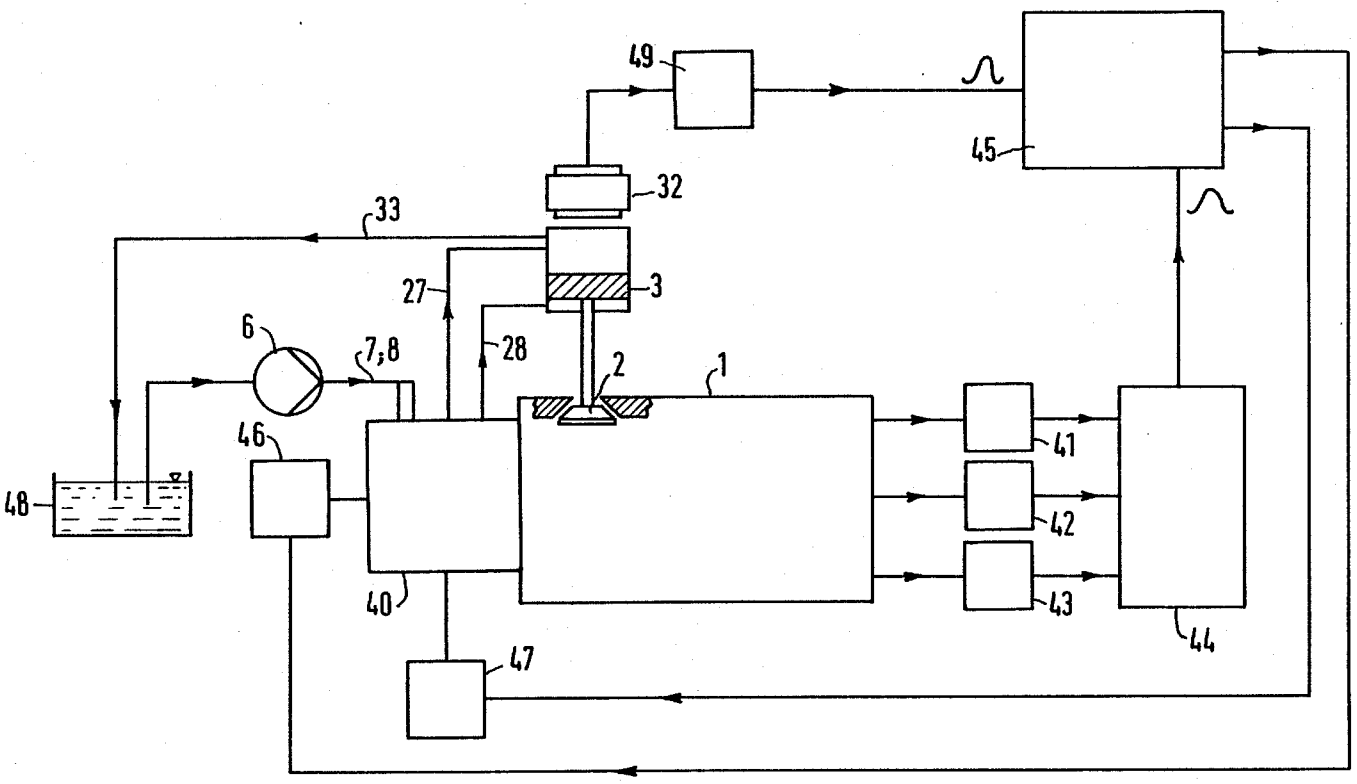
FIG. 4 is a diagrammatic and schematic block circuit diagram of a circuit for controlling the valve drive.

The rotating slide shown in FIG. 1 is shown at reference numeral 40 in the schematic illustration of FIG. 4. The operation of the internal combustion engine is monitored, for instance, by three measurement pickups and converters, namely an rpm meter 41, a torque meter 42 and a thermometer 43. The measured values are supplied to a process control computer and pulse generator 44, which calculates a set-point value for the particular valve position from the measured values and feeds it to a comparator 45. In the comparator 45, the set-point value is compared with an actual value for the instantaneous valve position. The actual value for the instantaneous valve position is amplified in an amplifier 49 after having been furnished by the contactless travel pickup 32 with the aid of which the position of the associated piston 3 is ascertained at each control cylinder 4. In order to adapt the actual value to the set-point value, the comparator 45 emits control signals to a first stepping motor 46, with which the movable part 14 of the auxiliary shaft is displaced, and to a second stepping motor 47, which actuates the positioning gear wheel 31. In accordance with prevailing conditions, one or another of the stepping motors 46, 47 can be actuated, or both can be actuated simultaneously. In the latter case, the result is a superposition of the variations in the valve characteristic shown in FIGS. 2 and 3. The hydraulic fluid positively displaced out of the cylinder 4 flows through a return line 33 into a reservoir 48 from which the pump 6 draws fluid.

The foregoing is a description corresponding in substance to German Application No. P 37 04 071.5, dated Feb. 10, 1987, the International priority of which is being claimed for the instant application, and which is hereby made part of this application. Any material discrepancies between the foregoing specification and the aforementioned corresponding German application are to be resolved in favor of the latter.

We claim:

1. Valve drive assembly for an internal combustion engine having a crankshaft, comprising:

(a) a given number of pistons, control valves each being connected to a respective one of said pistons and independently movable by hydraulic fluid acting upon said pistons, a housing, at least one rotatable link disposed in said housing for aiding in shutting off and releasing a supply of hydraulic fluid to said pistons at regular intervals, an auxiliary shaft supported in said at least one rotatable link and driven by the crankshaft;

(b) first and second conduits for each valve communicating with said pistons: a hydraulic pump; first and second supply lines for hydraulic fluid leading from said hydraulic pump to first and second annular grooves formed in said housing: said at least one rotatable link having said given number of radial third and fourth conduits formed therein communicating with said first and second annular grooves: said auxiliary shaft having fifth and sixth annular grooves formed therein communicating with said third and fourth conduits; fifth and sixth conduits communicating with said fifth and sixth annular grooves; seventh and eighth conduits for each valve communicating with said fifth and sixth conduits; third and fourth annular grooves leading respectively, from said seventh and eighth conduits to said first and second conduits: and (c) ribs dividing said fifth and sixth annular grooves into a number of sectors equivalent to said given number.

2. Valve drive assembly according to claim 1, wherein said at least one rotatable link is in the from of two links, and including means for rotating said links in mutually opposite directions relative to said housing.

3. Valve drive assembly according to claim 2, wherein said links have axes and crown gears disposed thereon, and said means for rotating said links are in the form of a positioning gear wheel between said links being rotatable transverse to said axes and meshing with said crown gears.

4. Valve drive assembly according to claim 1, wherein said auxiliary shaft is axially displaceable, and said fifth and sixth conduits have mouths on surfaces thereof in various cross-sectional planes occupying variously dimensioned portions of the periphery of said auxiliary shaft.

5. Valve drive assembly according to claim 4, wherein said auxiliary shaft is formed of two telescoping parts, one of said parts having said fifth and sixth annular grooves formed therein, and the other of said parts having drive elements.

6. Valve drive assembly according to claim 4, wherein said auxiliary shaft is formed of two telescoping parts, one of said parts having said fifth and sixth conduits disposed therein, and the other of said parts having drive elements.

7. Valve drive assembly according to claim 1, including positioning devices effecting axial displacement of said auxiliary shaft, and means for controlling said positioning devices in such a manner that said valves have a stroke and an opening time following set-point values determined as a function of measured operating parameters of the engine.

8. Valve drive assembly according to claim 1, including positioning devices effecting rotation of said at least one link toward one another, and means for controlling said positioning devices in such a manner that said valves have a stroke and an opening time following set-point values determined as a function of measured operating parameters of the engine.

9. Valve drive assembly according to claim 7, including a process control computer ascertaining a set-point value from current operating parameters of the engine, a travel pickup for each of said valves issuing a measurement signal, and a comparator receiving said measurement signal as an actual value and comparing said actual value with said set-point value ascertained by said process control computer, said comparator sending control signals to said positioning devices upon deviations of said actual value from said set-point value.

10. Valve drive assembly according to claim 8, including a process control computer ascertaining a set-point value from current operating parameters of the engine, a travel pickup for each of said valves issuing a measurement signal, and a comparator receiving said measurement signal as an actual value and comparing said actual value with said set-point value ascertained by said process control computer, said comparator sending control signals to said positioning devices upon deviations of said actual value from said set-point value.

11. Valve drive assembly according to claim 9, wherein said current operating parameters are selected from the group consisting of rpm, torque and temperature.

12. Valve drive assembly according to claim 10, wherein said current operating parameters are selected from the group consisting of rpm, torque and temperature.

* * * * *